US009730516B2

(12) United States Patent
Green et al.

(10) Patent No.: US 9,730,516 B2
(45) Date of Patent: Aug. 15, 2017

(54) TABLE MECHANISMS AND STRUCTURES

(71) Applicant: Apple Inc., Cupertino, CA (US)

(72) Inventors: Christopher M. Green, Woodside, CA (US); Kully Kraig Mandon, San Francisco, CA (US); Daniel McBroom, Leander, TX (US); Michael D. McBroom, Leander, TX (US); Charles A. Schwalbach, Menlo Park, CA (US); Jonathan P. Siegel, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/837,277

(22) Filed: Aug. 27, 2015

(65) Prior Publication Data

US 2016/0058173 A1 Mar. 3, 2016

Related U.S. Application Data

(60) Provisional application No. 62/045,470, filed on Sep. 3, 2014.

(51) Int. Cl.

| | |
|---|---|
| ***A47B 88/00*** | (2017.01) |
| ***A47B 88/407*** | (2017.01) |
| *A47F 7/02* | (2006.01) |
| *A47B 21/06* | (2006.01) |

(52) U.S. Cl.

CPC ..... *A47B 88/407* (2017.01); *A47B 2021/066* (2013.01); *A47F 7/02* (2013.01)

(58) Field of Classification Search

CPC ..... A47B 88/0407; A47B 88/12; A47B 88/22; A47B 2210/02

USPC ..... 108/50.01, 50.02, 25, 143; 312/223.3, 312/223.6, 334.6, 246, 330.1, 194–196

See application file for complete search history.

(56) References Cited

U.S. PATENT DOCUMENTS

| | | | | |
|---|---|---|---|---|
| 1,896,600 | A * | 2/1933 | Vance | A47B 88/0407 312/241 |
| 2,823,460 | A * | 2/1958 | Weiler | E04C 2/36 156/210 |
| 5,350,229 | A * | 9/1994 | Smed | A47B 88/00 312/333 |
| 7,401,442 | B2 * | 7/2008 | Clark | F16B 5/0092 428/116 |
| 7,980,642 | B2 * | 7/2011 | Lam | A47B 88/0422 312/333 |
| 9,254,038 | B2 * | 2/2016 | Molteni | A47B 88/04 |
| 2007/0040483 | A1 * | 2/2007 | Arkay-Leliever | A47B 21/06 312/194 |
| 2008/0295745 | A1 * | 12/2008 | Hamilton | A47B 13/06 108/50.02 |

(Continued)

FOREIGN PATENT DOCUMENTS

| | | | |
|---|---|---|---|
| EP | 0927530 | * | 7/1999 |

*Primary Examiner* — Janet M Wilkens

(74) *Attorney, Agent, or Firm* — Sterne, Kessler, Goldstein & Fox P.L.L.C.

(57) ABSTRACT

A table with drawers for displaying electronic devices is disclosed. The table may include a support beam and support panel within the table top for structural support. The table may include one or more drawers coupled to a carriage mechanism positioned rearward from the rear of the drawer. The carriage mechanism may be configured for moving the drawer from a first position to a second position.

23 Claims, 17 Drawing Sheets

(56) References Cited

U.S. PATENT DOCUMENTS

| | | | | |
|---|---|---|---|---|
| 2014/0053759 | A1* | 2/2014 | Matthai | A47B 21/0314<br>108/50.02 |
| 2014/0062145 | A1* | 3/2014 | Iacovoni | A47B 83/02<br>297/135 |
| 2015/0320203 | A1* | 11/2015 | Mandon | A47B 21/06<br>108/20 |

* cited by examiner

TABLE MECHANISMS AND STRUCTURES

CROSS-REFERENCE TO RELATED APPLICATION(S)

This application claims priority to U.S. Provisional Application No. 62/045,470, filed on Sep. 3, 2014, which is incorporated herein in its entirety by reference thereto.

FIELD

The described embodiments relate generally to tables with drawers for displaying electronic devices. More particularly, the present embodiments relate to mechanisms and structures for tables and drawers.

BACKGROUND

A retailer or other person may desire to provide a table having drawers for housing or displaying electronic devices.

SUMMARY

A retailer or other user may have various locations within a store or other location for using, displaying, testing, and/or providing technical assistance for electronic devices. The retailer may wish to provide tables at these locations to provide a convenient place for people (e.g., customers, salespeople, and technical support personnel) to use the electronic devices. The retailer may wish to provide storage within the tables to provide a convenient place for people (e.g., salespeople and technical support personnel) to access the electronic devices.

In some embodiments of the present invention, a table is provided with drawers conveniently located beneath a lower surface of the table. The drawers may be used as storage space and reduce clutter on the table top surface. The table top surface remains as a flat expanse to maximize working surface.

To accomplish this and other objectives, the retailer may use a table or elements thereof according to embodiments described herein.

In some embodiments, a table includes a table top and a support beam and a support panel. The support panel may be disposed above the support beam. The support beam may include a longitudinally extending branch, a first transversely extending branch extending from a first end of the longitudinally extending branch, and a second transversely extending branch extending from a second end of the longitudinally extending branch. The support panel may include a middle panel, a top sheet extending over and fixed to a top side of the middle panel, and a bottom sheet extending over and fixed to a bottom side of the middle panel.

In some embodiments, a table includes a table top defining an upper surface and a lower surface with a drawer disposed below the table top. The drawer may include side panels defining inner side cavities with a rear opening at a rear of the drawer. The drawer may include a carriage mechanism disposed within the drawer side panels and extending through the opening at the rear of the drawer for moving the drawer between a first position and a second position.

In some embodiments, a table includes a table top defining an upper surface and a lower surface with a drawer disposed below the table top. The drawer may include a carriage mechanism for moving the drawer between a first position and a second position. The carriage mechanism may include a bracket connected to the drawer. The bracket may include a mounting panel fixed to the bottom surface of the table top and an extension arm extending toward the drawer. The carriage mechanism may include a carriage coupled to an upper surface of the bracket. The carriage may include a longitudinal groove and opposing longitudinal protrusions. The carriage mechanism may include a rail coupled to the drawer. The rail may extend from a rear of the drawer and may include opposing longitudinal grooves and a longitudinal protrusion. The rail longitudinal protrusion may be at least partially disposed within the carriage longitudinal groove. The carriage longitudinal protrusions may be at least partially disposed within rail opposing longitudinal grooves. The rail may be configured to slide along the carriage to move the drawer from a first position to a second position.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
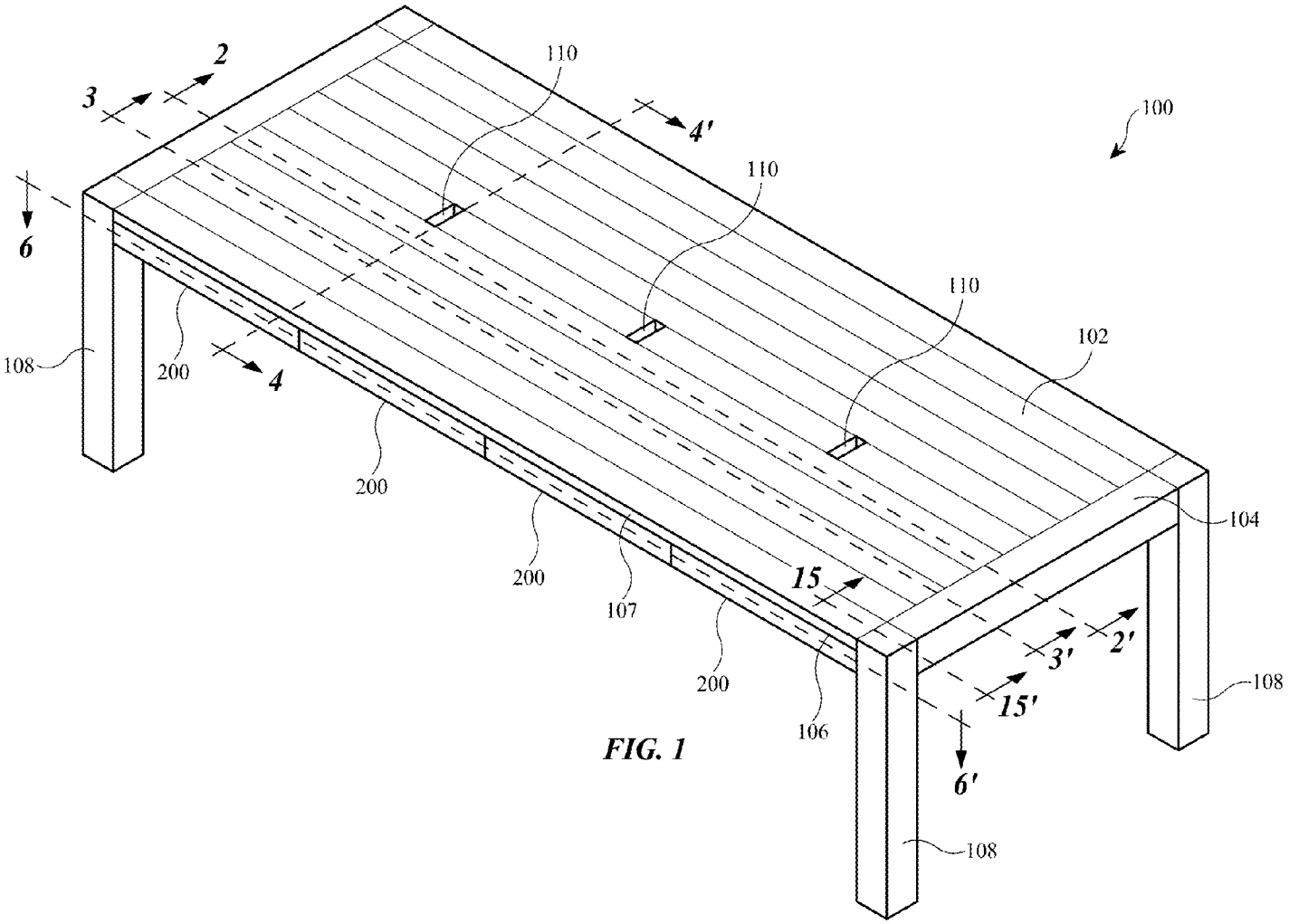
FIG. 1 shows a perspective view of a table according to some embodiments.

Reference will now be made in detail to representative embodiments illustrated in the accompanying drawings. It should be understood that the following descriptions are not intended to limit the embodiments to one preferred embodiment. To the contrary, they is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

A retailer or other user may have various locations within a store or other location for using, displaying, testing, and/or providing technical assistance for electronic devices. The retailer may wish to provide tables at these locations to provide a convenient place for people (e.g., customers, salespeople, and technical support personnel) to use the electronic devices. Furthermore, the retailer may wish to provide storage within the tables to provide a convenient place for people (e.g., salespeople and technical support personnel) to access the electronic devices.

A table is typically provided with support within a table top and table legs. The table top typically includes structural support along all perimeters of the table top. This structural support in the table provides reinforcement for the table top and helps distribute force applied to the table top.

A retailer may wish to provide drawers conveniently located beneath the table top. In some embodiments, drawers beneath the table top may be mounted to the bottom surface of the table top, occupying space that could otherwise be occupied by a perimeter support structure. In some embodiments, to maintain optimum structural integrity of the table, an internal support structure may be provided and may support the table at locations displaced from its perimeter, to leave room for drawers to be positioned immediately below the table top.

In some embodiments, structural support for the table is provided by a support structure having structural beams and a support panel extending from all sides of the table. The structural beams and support panel may compensate for the lack of support structure along the perimeters of the table top (e.g., in areas occupied by drawers). The structural beams and support panel may strengthen the table top by transferring force applied to one part of the table to legs at the ends of the table. The support beam and support panel may reinforce the table by distributing force applied to one part of the table through the table top and to legs thereof. Although this document describes the table in terms of a retailer facilitating use, display, testing or technical assistance related to electronic devices, the table can be used in any situation, for example, a dining table, kitchen table, side table, coffee table, desk, a temporary workstation, or mobile kiosk for electronic devices.

These and other embodiments are discussed below with reference to FIGS. 1-16. However, those skilled in the art will readily appreciate that the detailed description given herein with respect to these figures is for explanatory purposes only and should not be construed as limiting.

Embodiments of the present invention include a table 100 with drawers 200 (e.g., for housing or storing electronic devices). Table 100 may include a support structure including support beam 114 and support panel 116. Table 100 may include one or more drawers 200, each having a carriage mechanism 300 for moving drawer 200 from a first, closed, position to a second, open, position. In some embodiments, the elements and systems described herein (e.g., table 100 including support beam 114, support panel 116, drawers 200, and/or carriage mechanism 300) may be used in conjunction with one or more of the elements and systems described in U.S. Patent Application Nos. 62/045,474, 62/045,455, and 62/045,457, all filed on Sep. 3, 2014 (e.g., the display systems and/or components thereof disclosed in these applications). Each of these applications is incorporated herein in its entirety by reference thereto.

As shown in FIGS. 1-5, table 100 may include a table top 102 having an upper surface 104, a lower surface 106, and a side surface 107, and also may include legs 108. Table top 102 may define one or more apertures 110. In some embodiments, instead of discrete openings as shown in FIG. 1, aperture 110 is a continuous slot running longitudinally along the center of table top 102. In some embodiments, table top 102 has a continuous surface (e.g., formed having, for example, no aperture, cavity, gap, opening, etc.). In some embodiments, aperture 110 is an electrical port or a pass-through for electrical wires (e.g., that may be connected to electrical ports within or below table top 102). As used herein, "electrical ports" encompasses both data ports and power ports. In some embodiments, table 100 may include an electrical cord 112 for providing data or power to ports and/or devices within table 100. In some embodiments, table top 102 has a continuous surface (e.g., formed in a single segment having, for example, no aperture, cavity, gap, opening, etc.).

Some conventional tables may include structural support around the table, including along all perimeters of the table top. This structural support may reinforce the strength of the table top and help distribute force applied to the table top. Structural support throughout the table, including along the perimeter of the table top, may interrupt features or accessories beneath the table top surface, preventing features or accessories from mounting to the bottom surface of the table top. Such structural support may interfere with use of the table top and areas beneath the table top.

In embodiments of the present invention, structural support may be positioned throughout table top 102 in a manner that minimally interferes with areas beneath table top 102, to provide an optimal environment for mounting features to lower surface 106 of table top 102, such as, for example, drawers 200. The structural support provided in embodiments of the present invention helps allow space beneath table top 102 to be maximally utilized, in part by minimizing disposition of support structures along longitudinal peripheral sides of table top 102.

FIGS. 2-4 and 6 show cross-sectional views of table 100 according to some embodiments, where table 100 includes a support beam 114 and a support panel 116. In some embodiments, support beam 114 may include a longitudinally extending branch 120, a first transversely extending branch 122, and a second transversely extending branch 124. First transversely extending branch 122 may extend from a first end of longitudinally extending branch 120 and second transversely extending branch 124 may extend from a second end of longitudinally extending branch 120. Table 100 may include support beams 118 along transverse sides 150 of table top 102.

In some embodiments, longitudinally extending branch 120, first transversely extending branch 122, and second transversely extending branch 124 are connected in the form of an I-shape. Support beam 114 is not limited to an "I-shape," but may have any shape including a longitudinally extending branch and a transversely extending branch extending therefrom, including, but not limited to, a T-shape, an L-shape, a triangle, etc. Support beam 114 may be metal (e.g., steel or aluminum). In some embodiments, longitudinally extending branch 120 may extend longitudinally within the longitudinal middle third of table top 102. For example, where table 100 includes aperture 110 positioned longitudinally centrally, longitudinally extending branch 120 may be positioned adjacent to aperture 110 offset from a longitudinal center of table top 102 to support the structure. In some embodiments, longitudinally extending branch 120 may extend along the longitudinal center of table top 102. Support panel 116 may be disposed above support beam 114 and may include a middle panel 130, a top sheet 132 extending over and fixed to a top side of middle panel 130, and a bottom sheet 134 extending over and fixed to a bottom side of middle panel 130. Support panel 116 (including top sheet 132, bottom sheet 134, and middle panel 130) may extend throughout most of the length and width of table top 102 (e.g., greater than ¾ of the length of table top 102 and greater than ¾ of the width of table top 102). In some embodiments, top sheet 132 and bottom sheet 134 may extend continuously over the entire length and width of support panel 116. In some embodiments middle panel 130 of support panel 116 may be a honeycomb structure 140. In some embodiments honeycomb structure 140 of middle panel 130 may include interruptions to accommodate support blocks 142 as described below. Middle panel 130 is not limited to a panel with a honeycomb configuration of a hexagonal shape, but may have any shape including a panel with an array of hollow cells formed between vertical walls. Top sheet 132, bottom sheet 134, and middle panel 130 may be metal (e.g., steel or aluminum).

Figure 2:
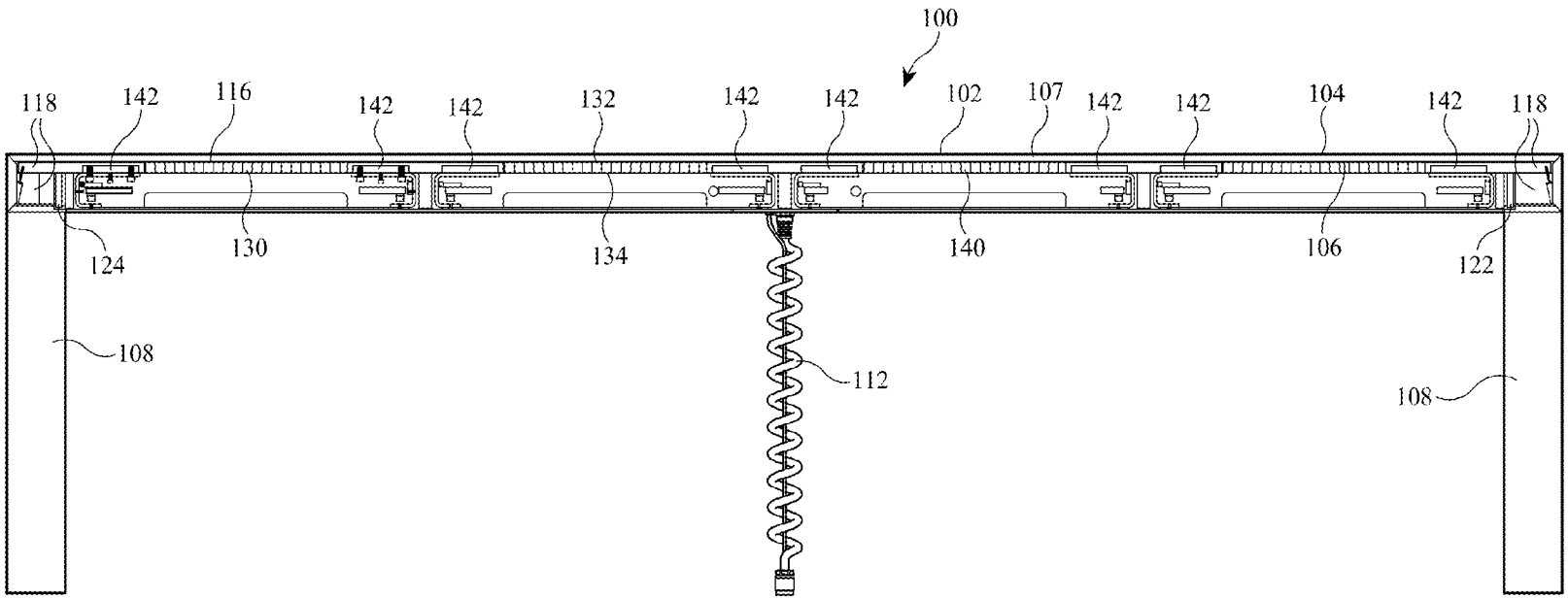
FIG. 2 shows a cross-sectional side view of a table according to some embodiments, taken along line 2-2' of FIG. 1.
Figure 3:
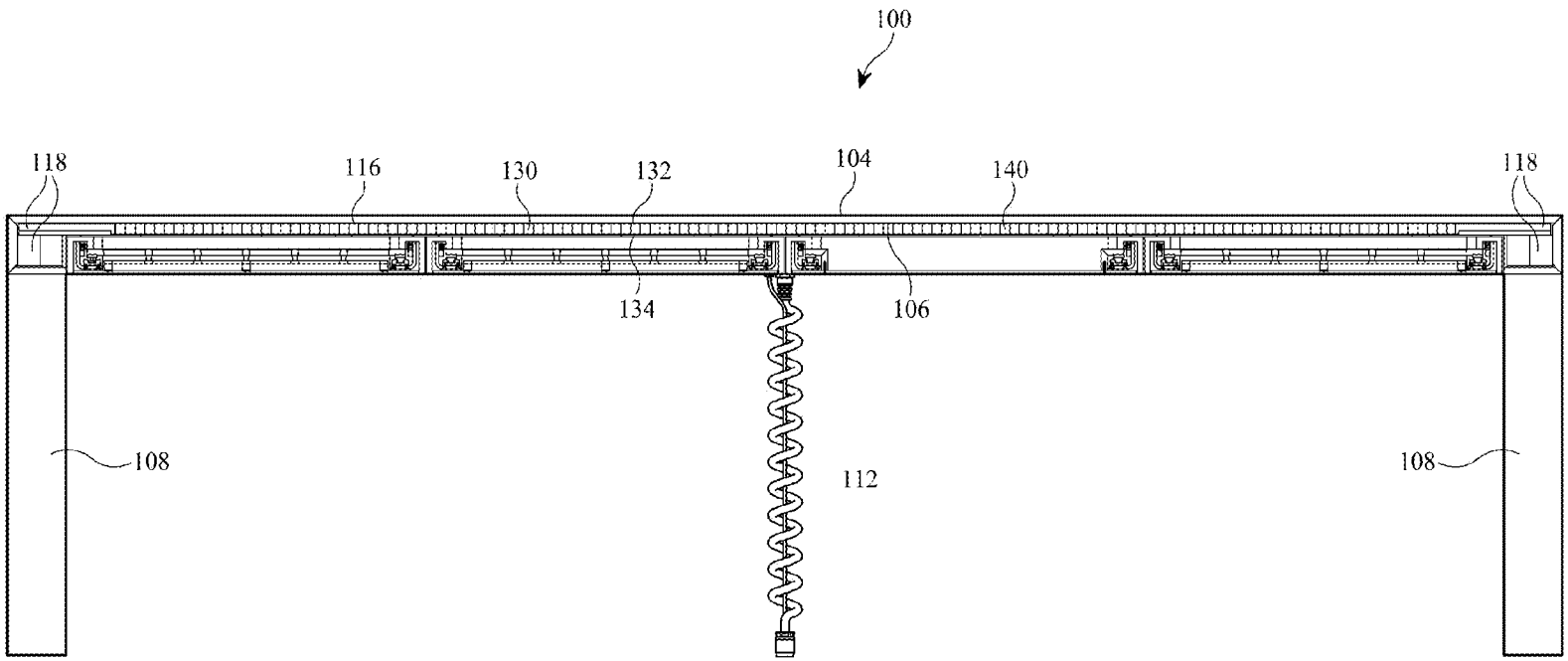
FIG. 3 shows a cross-sectional side view of a table according to some embodiments, taken along line 3-3' of FIG. 1.
Figure 4:
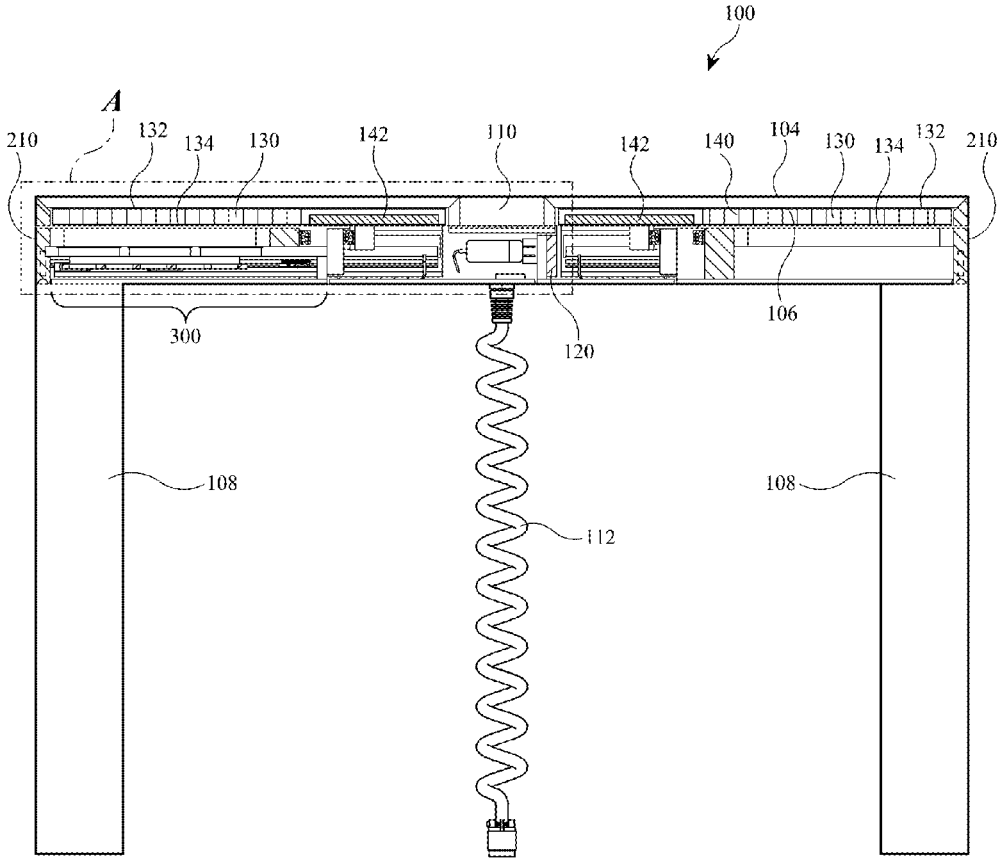
FIG. 4 shows a cross-sectional side view of a table according to some embodiments, taken along line 4-4' of FIG. 1.
Figure 8:
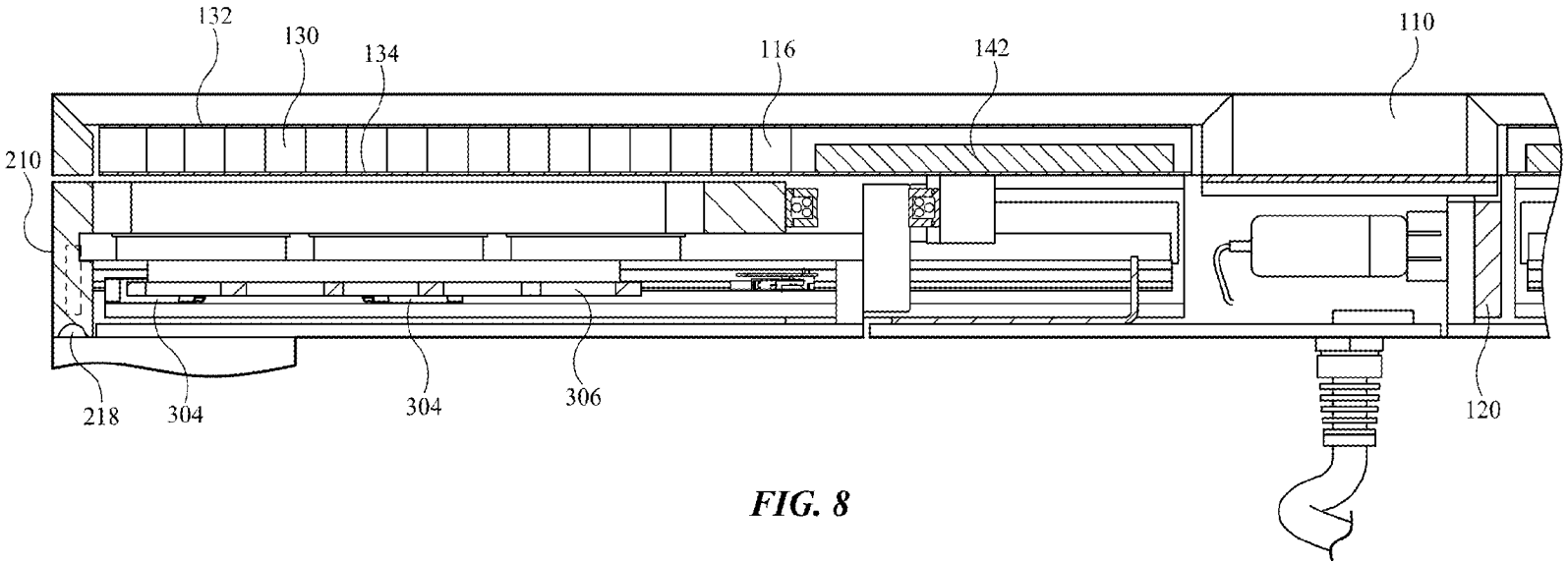
FIG. 8 shows an enlarged view of area A of FIG. 4.

As shown in FIGS. 2, 4, and 8, support panel 116 may include one or more support blocks 142 disposed within the middle panel 130 of support panel 116. Top sheet 132 may be disposed on top of support block 142 and bottom sheet 134 may be disposed beneath support block 142. Support blocks 142 may form part of middle panel 130, adjacent to honeycomb structure 140 thereof. In some embodiments, support blocks 142 may have greater density than middle panel 130 (e.g., to more securely hold fasteners such as, for example, clamps, screws, bolts, adhesive, and welds). Support blocks 142 may be located anywhere additional structural support is needed (e.g., at areas where drawers 200 are attached to table top 102). Portions of support panel 116 including support blocks 142 may be more equipped to handle greater applied force than portions of support panel 116 that do not include support blocks 142. For example, portions of the table top 102 that include support blocks 142 within support panel 116 may be better suited to stably hold a drawer 200 beneath table top 102 than portions of table top 102 that do not include support blocks 142 within support panel 116. In some embodiments, support blocks 142 may be located where hardware is attached to table top 102 (e.g., via fasteners such as, for example, clamps, screws, bolts, adhesive, and welds). For example, the greater density of support blocks 142 may allow for a stronger connection between fasteners holding hardware of drawer 200 to table top. In some embodiments, hardware may be fixed to table top 102 according to locations of support blocks 142.

Some conventional tables transfer force applied to the table to a structural support flange along the perimeter of the table top (e.g., extending between table legs) and to the ground or floor through legs of the table. Transfer of the applied force can help the table to remain supported at the point of contact and to distribute the force applied throughout the table to the legs. This transfer helps to minimize concentration of force in a relatively small area (e.g., immediately where applied) to thereby maintain structural integrity of the table and minimize the potential for damage to the table.

In some embodiments of the present invention, transversely extending branches 122 and 124 of support beam are disposed along opposing transverse sides 150 of table top 102 (see FIG. 1). Support beams 118 may also be disposed at transverse sides 150 of table top 102 extending between and connecting to adjacent legs 108. In some embodiments, support beams 118 extend below table top 102. In some embodiments, transversely extending branches 122 are coupled to support beams 118 (e.g., via mechanical fasteners 126 such as, for example, clamps, screws, bolts, adhesive, and welds, see FIG. 6). Together, support beams 118 and transversely extending branches 122 and 124 may support table 100 in a transverse direction, and may direct forces applied to table 100 along their lengths to legs 108. In some embodiments, support beams 118 are longer than transversely extending branches 122, and so forces applied through transversely extending branches 122 are carried to legs 108 by support beams 118.

Figure 6:
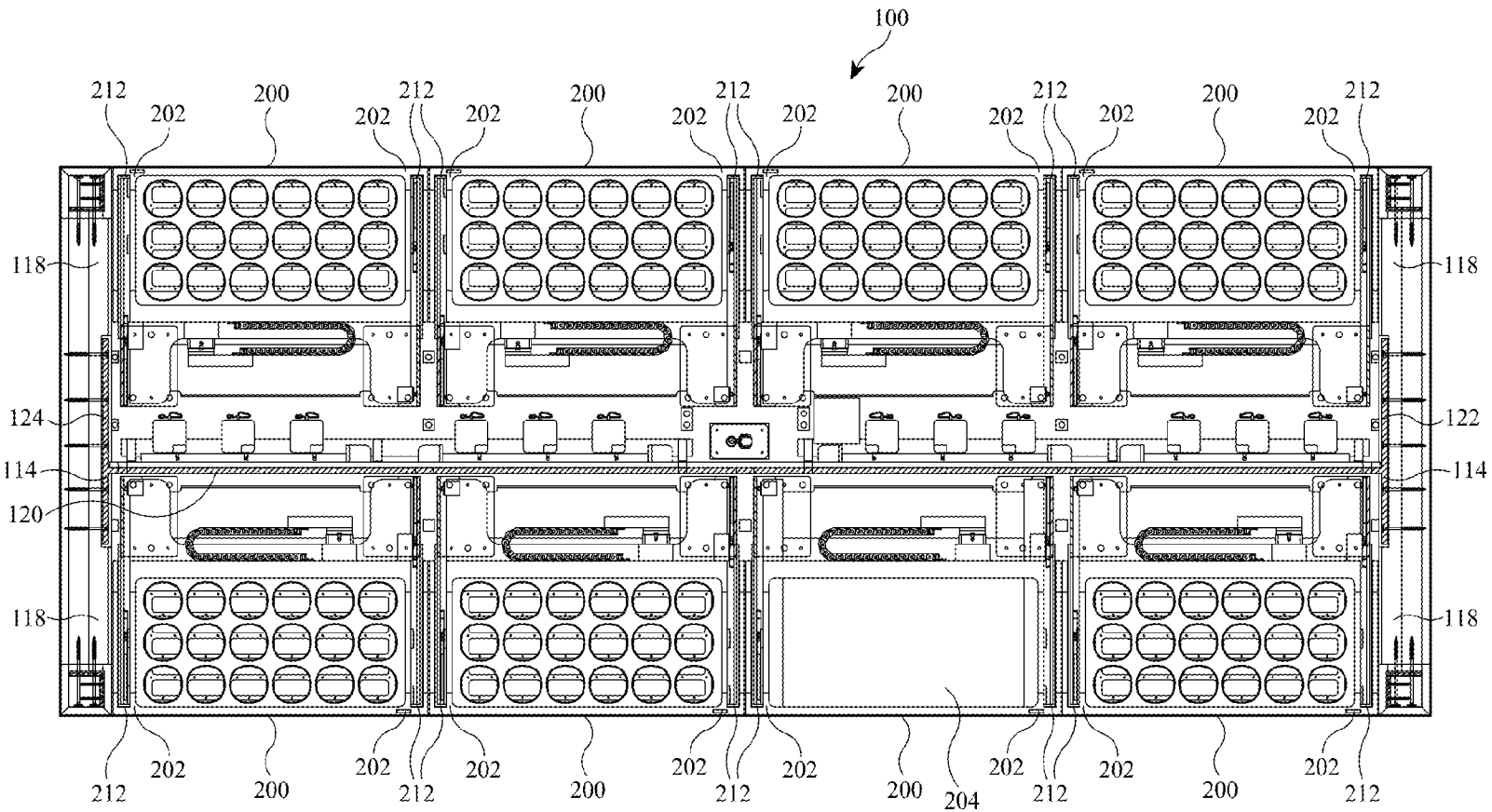
FIG. 6 shows a cross-sectional top plan view of a table according to some embodiments, taken along line 6-6' of FIG. 1.

In some embodiments, table top 102 does not have support beams extending between legs 108 along its longitudinal sides 152. This may be in order to accommodate drawers in this area (e.g., below table top 102 in the same plane as transverse support beams 118). Longitudinally extending branch 120 of support beam 114 compensates for this lack of side support beams. As shown in FIG. 6, longitudinally extending branch 120 extends longitudinally within a middle longitudinal area of table top 102 (e.g., a middle third or middle quarter of table top 102). This inner position leaves room for drawers 200 or other fixtures along longitudinal sides 152. Longitudinally extending branch 120 supports table 100 in the longitudinal direction, and may direct forces applied to table 100 along its length to transversely extending branches 122 and 124, which direct the force transversely along transverse sides 150 toward longitudinal sides 152 and ultimately to table legs 108 and the ground or floor beneath them. In this way, table top 102 remains longitudinally supported even without support beams along its longitudinal sides 152 (e.g., within outer thirds of table top 102).

Support panel 116 may help more directly transfer force throughout table top 102 to support beam 114, and thereby to legs 108 and ground. Support panel 116 may be a rigid structure, due in part to its layered structure (including middle panel 130, top sheet 132, and bottom sheet 134). Its rigidity allows forces to more directly transfer through it to support beam 114 disposed beneath it (e.g., rather than retaining applied force through bending or otherwise deforming). As shown in FIG. 2, rigid support panel 116 may rest on and be directly coupled to support beam 114 (e.g., along transversely extending branches 122 and 124), to directly transfer such force. The connection between support panel 116 and support beam 114 may also help support the rigidity of support panel 116. For example, longitudinally extending branch 120 may resist bowing of support panel 116 in the longitudinal direction (e.g., when a force is applied centrally to table top 102).

For example, force applied to an area of table 100 above a drawer 200 may transfer to support panel 116, which may transfer it to longitudinally extending branch 120 and transversely extending branches 122 and 124. Longitudinally extending branch 120 may also transfer its force to transversely extending branches 122 and 124. Transversely extending branches 122 and 124 may transfer the force to legs 108 (e.g., via support beam 118).

Figure 5:
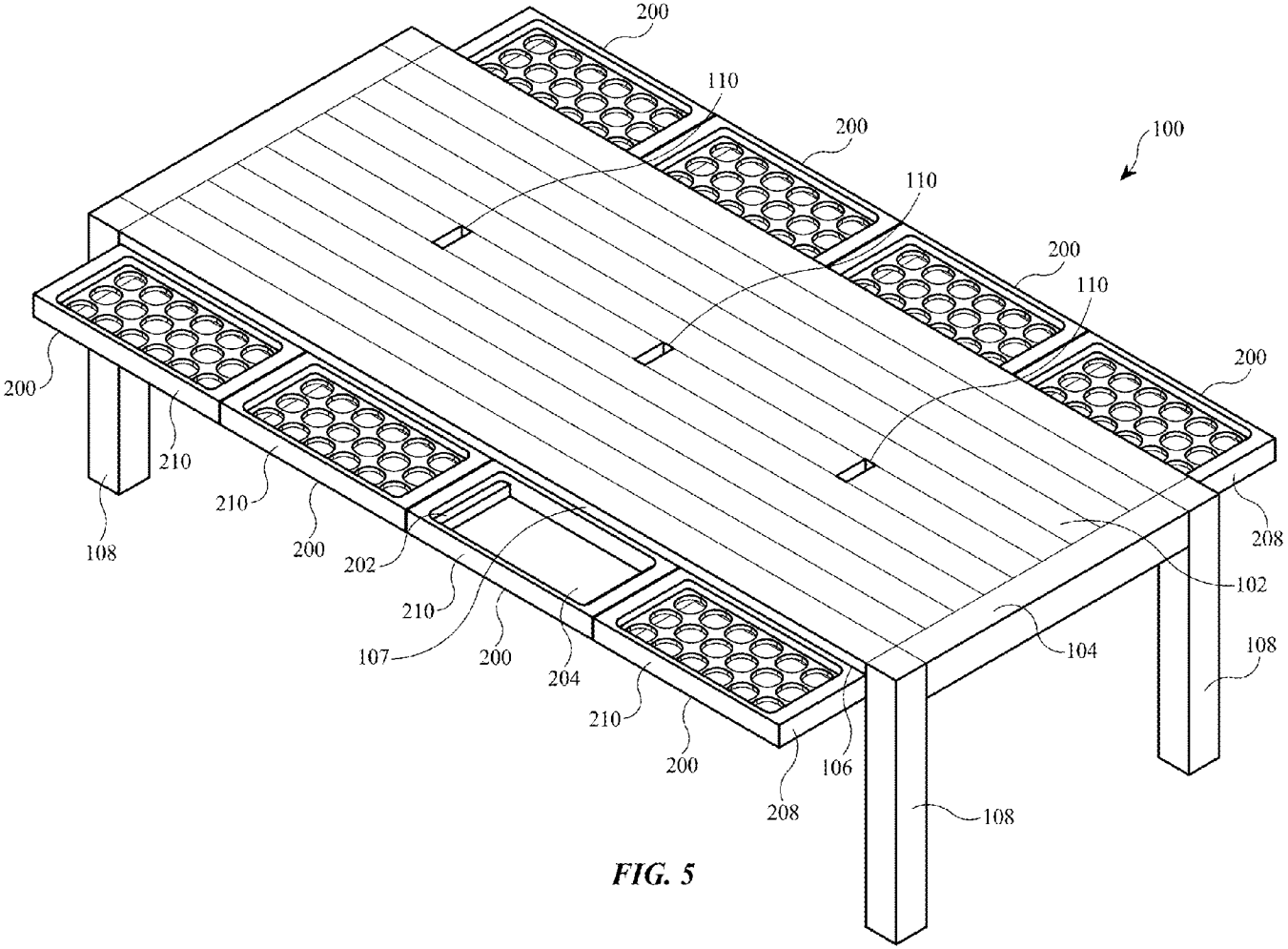
FIG. 5 shows a perspective view of a table according to some embodiments.

As shown in FIG. 5, table 100 may have one or more drawers 200. Drawers 200 may include a peripheral wall 202 defining an inner drawer cavity 204. Peripheral wall 202 may include hollow side panels 212 having outer side surfaces 208. In some embodiments, outer side surfaces 208 may be bare. For example, they may include no hardware or other overlying or interrupting elements extending out from side surfaces 208. The lack of elements extending out from side surfaces 208 allow side surfaces 208 of adjacent drawers to be positioned immediately adjacent, with no between adjacent side surfaces 208. For example, adjacent side surfaces 208 may be spaced apart by less than ½ inch (e.g., less than ¼ inch or less than ⅛ inch). This helps maximize drawer space and minimize visual or mechanical interruption between adjacent drawers 200. In some embodiments, bare outer side surfaces 208 may also be continuous, having no holes or voids. Bare continuous side surfaces 208 can help present clean side surfaces when the drawers are open for providing an aesthetically pleasing appearance. Furthermore, not having drawer mechanisms or other hardware exposed on side surfaces 208 can help minimize the potential for tampering or inadvertent damage to drawer mechanisms or other hardware.

In some embodiments, as shown, for example, in FIG. 5, drawer 200 may include a front surface 210. In some embodiments, front surface 210 may be formed by a panel having a flat front surface 210. In some embodiments of table 100, front surface 210 may be bare. Examples of a bare surface are described herein with respect to the bare outer side surfaces 208. Bare front surface 210 may be flush with the edge of table top 102 when drawer 200 is closed (See FIG. 1), meaning that side surface 107 of table top 102 may be parallel to and coplanar with front surface 210 of drawer 200 at their interface(s) (e.g., aligned within a tolerance of +/−⅛ inch, which is generally imperceptible to a casual observer and will not interfere with the use and appearance of side surface 107 and front surface 210 together as aligned surfaces).

As shown in FIG. 4, no portion of drawer 200 extends forward of side surface 107 when drawer 200 is closed. This helps to prevent clothing, hands, data cords, or other objects from catching on the edge of the drawer and helps to minimize physical and visual interruption between side surface 107 and drawer 200, thereby better presenting clean side surfaces of table top 102.

In some embodiments of the present invention, a table 100 may include a plurality of drawers 200 arranged side-by-side, which may have front surfaces 210 parallel to one another along the same geometric plane when drawers 200 are in the same position (e.g., closed or open the same amount), as shown in FIGS. 1-5 and 7. In some embodiments, these drawers 200 are disposed immediately adjacent one another. Adjacent drawers 200 may have no intervening hardware or other overlying or interrupting elements between their respective outer side surfaces 208. Adjacent drawers 200 may have bare front surfaces 210 that are flush with side surface 107 of table top 102 when drawers 200 are closed. Front surface 210 of drawer 200 may be flush with the surface of front surfaces 210 of adjacent drawers 200 when drawers 200 are closed.

Figure 7:
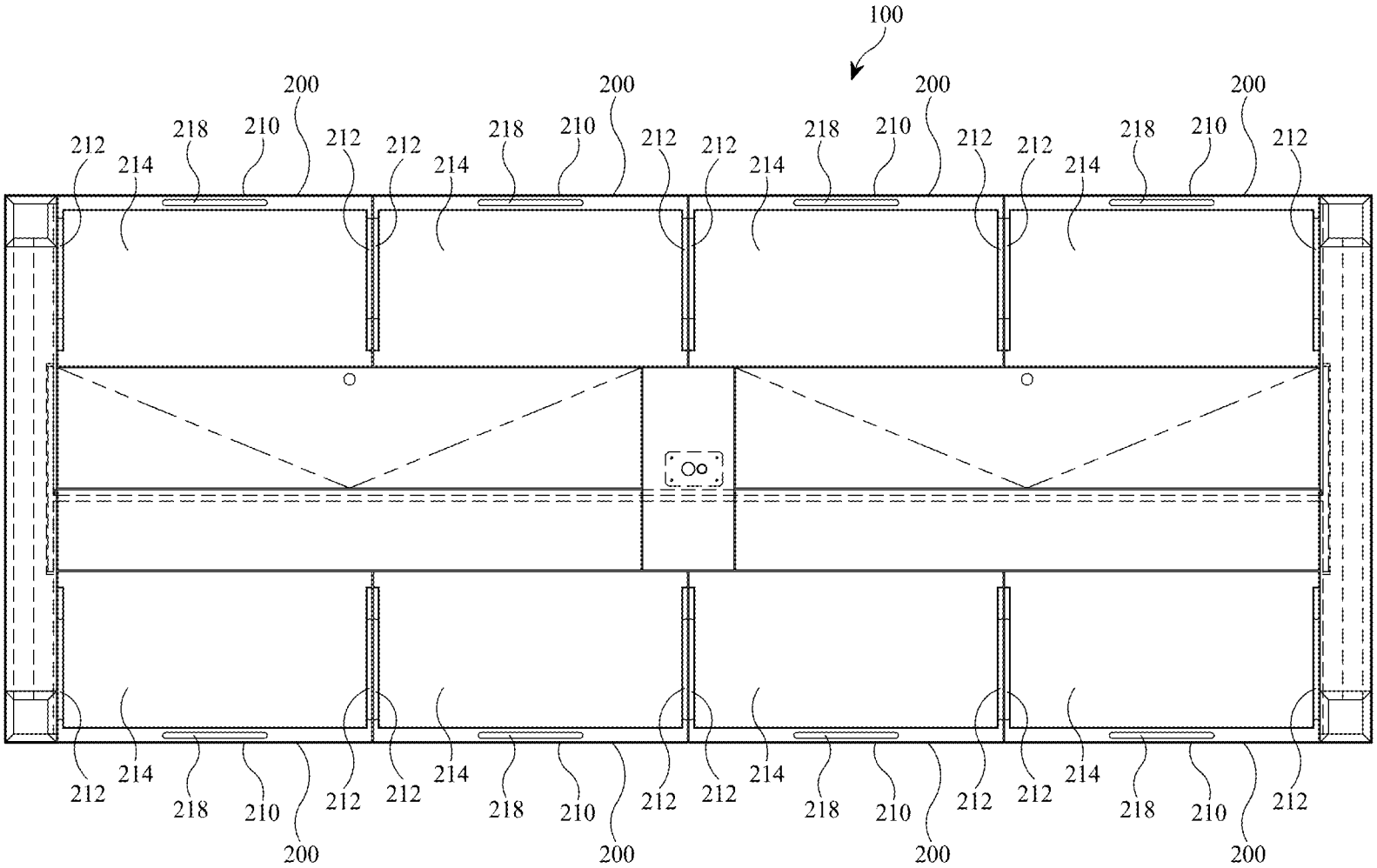
FIG. 7 shows a bottom view of a table according to some embodiments.
Figure 12:
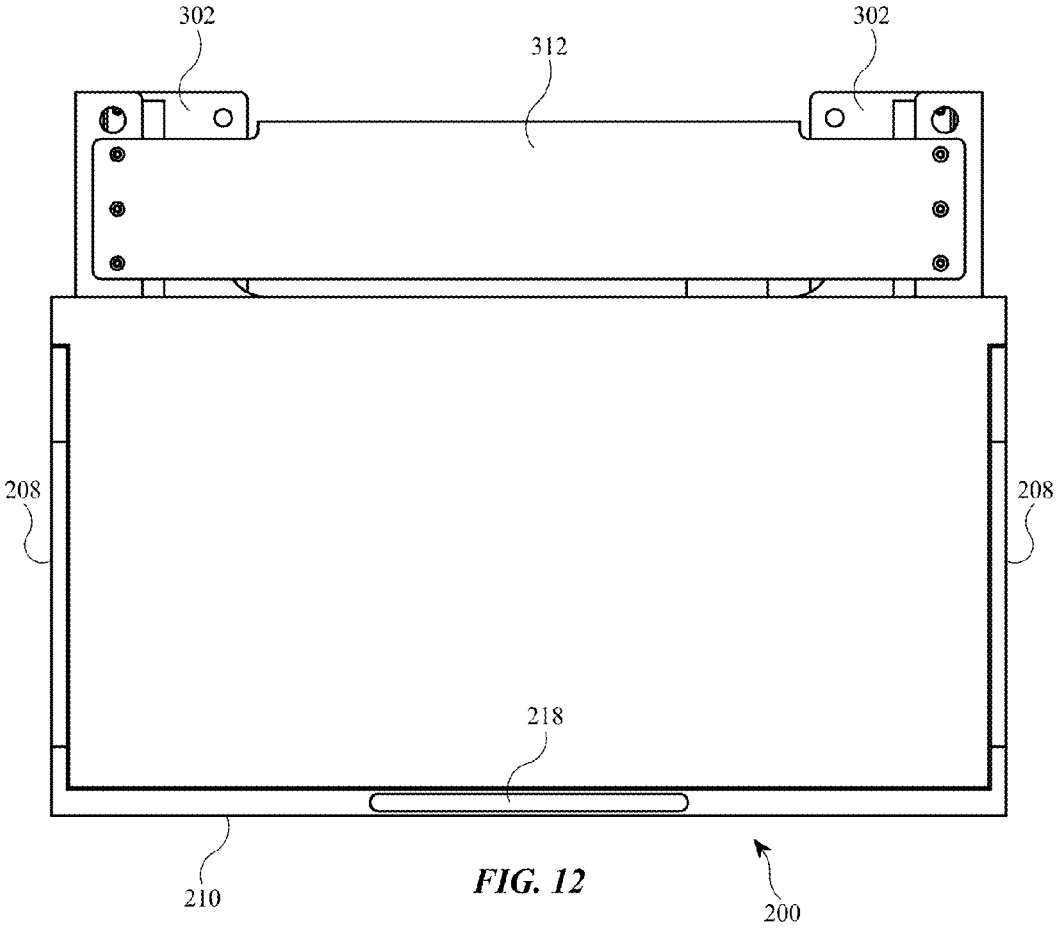
FIG. 12 shows a bottom view of a drawer according to some embodiments.

In some embodiments, as shown in FIGS. 7 and 12, drawer 200 may include a bottom surface 214. In some embodiments, bottom surface 214 may be at least partially formed by a bottom panel 216 having a flat bottom surface 214. In some embodiments, bottom surface 214 may define a cutout 218. Cutout 218 may help drawer 200 to be easily opened or closed. For example, a person accessing drawer 200 may reach beneath drawer 200 to bottom surface 214 and pull drawer 200 open at cut out 218. A person may reach beneath drawer 200 to bottom surface 214 to push drawer 200 closed at cut out 218. In some embodiments, cut out 218 may be located within a bottom surface of a panel forming front surface 210, as shown in FIG. 12. In some embodiments, the bottom surface 214 may be bare. In some embodiments the bottom surface 214 may be bare except for cutout 218. Examples of a bare surface are described herein with respect to the bare outer side surfaces. For example, bottom surface 214 may include no hardware or other overlying or interrupting elements extending out from bottom surface 214.

Some conventional tables with drawers may include drawers typically supported along the outer sides or bottoms of the drawers. These drawers typically open and close by drawer movement mechanisms such as glides located along the sides or bottoms of the drawers. These movement mechanisms may be visible and easily accessible, and may interrupt bare or continuous surfaces of the drawers (e.g., by protruding therefrom). Visible movement mechanisms may increase the potential for tampering or inadvertent damage to the drawer, including its mechanisms. Drawers of some conventional tables may be structurally supported along the side of the drawer, external to the drawer.

In some embodiments, drawers 200 may include a carriage mechanism 300 for moving the drawer 200 between a first position and a second position, as shown in FIGS. 6 and 9-16, where drawer 200 is closed in a first position (see, e.g., FIG. 1) and open in a second position (see, e.g., FIG. 5). In some embodiments, elements of carriage mechanism 300 may be positioned rearward of the drawer 200, and in some embodiments elements of carriage mechanism 300 may be positioned within portions of drawer 200. This positioning of carriage mechanism 300 allows movement of drawer 200 while not contributing any visual or physical element to exterior portions of drawer 200 that are visible or accessible during normal operation (e.g., outer side surfaces 208, bottom surface 214, or inner cavity 204 of drawer 200). For example, carriage mechanism 300 may not be visible from a perspective above the table top when drawer 200 is open or closed. In such embodiments, the potential for tampering or inadvertent damage to drawer 200 or its mechanisms (e.g., carriage mechanism 300) is minimized.

Figure 11:
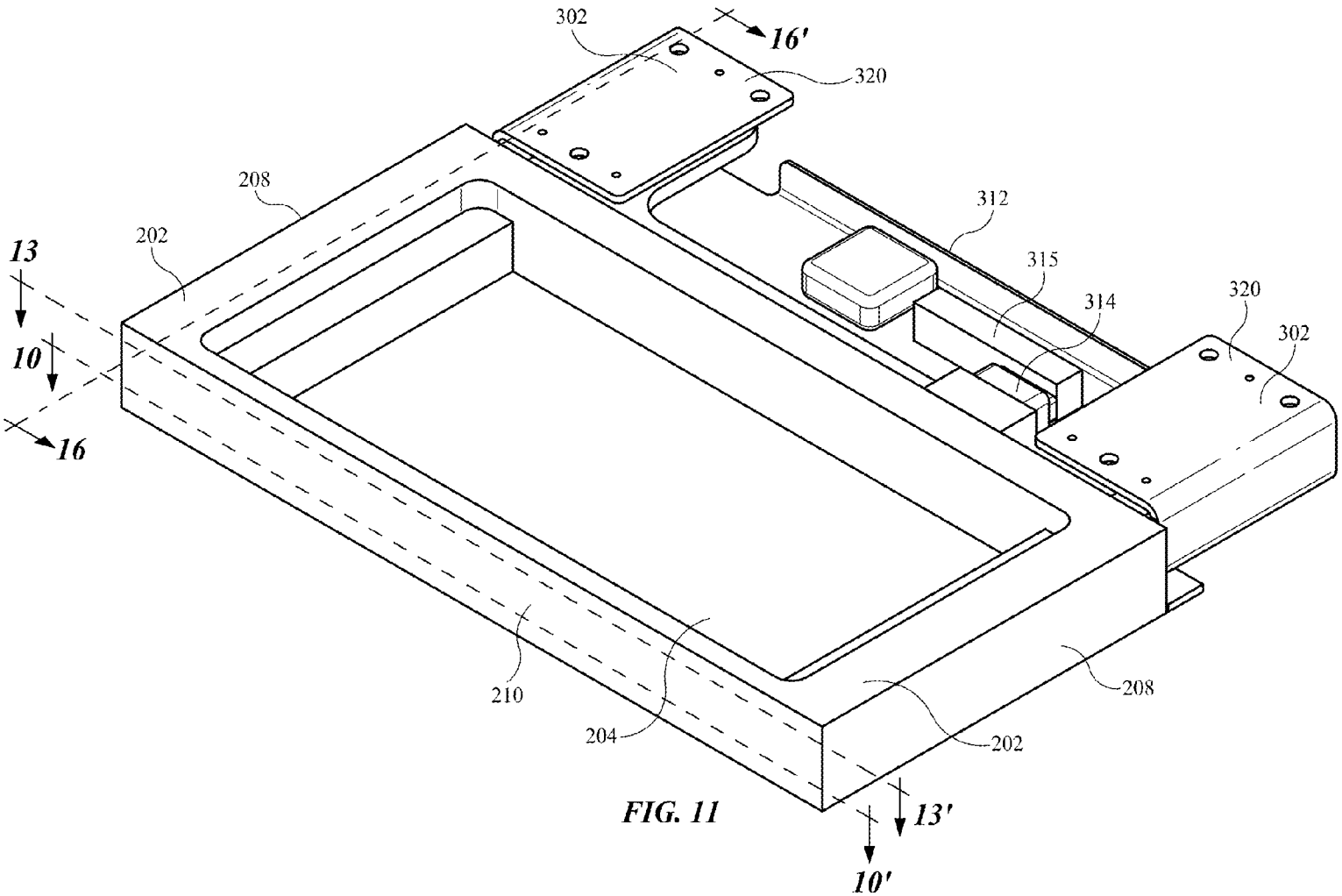
FIG. 11 shows a perspective view of a drawer according to some embodiments.

In some embodiments, carriage mechanism 300 may include a bracket 302 extending from the rear of drawer 200 (see, e.g., FIGS. 11 and 12). Bracket 302 may include a mounting panel 320 and an extension arm 322. In some embodiments two brackets 302 are used per drawer 200, including two bracket extension arms 322, one for each hollow side panel 212 of drawer 200, and two mounting panels 320, one for each bracket extension arm 322. A pair of brackets 302 may be coupled together by lower support member 312 extending therebetween (see, e.g., FIG. 12). Mounting panel 320 may be fixed to table top lower surface 106 at a position rearward of drawer 200. Extension arm 322 may extend toward drawer 200 and into cavity 230 of side panel 212 via opening 206. In some embodiments, carriage mechanism 300 may include a lower support 312 fixed to extension arm 322.

Carriage mechanism 300 may include at least one carriage 304 fixed to an upper surface of bracket extension arm 322

Figure 10:
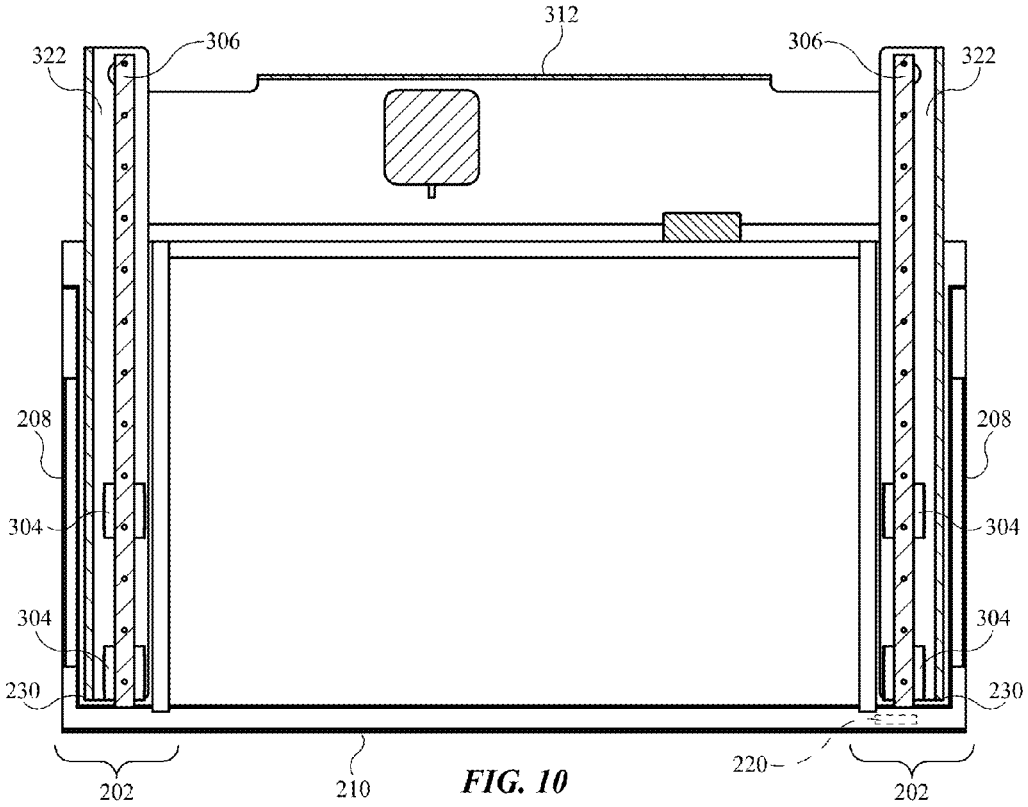
FIG. 10 shows a cross-sectional view of a drawer according to some embodiments, taken along line 10-10' of FIG. 11.
Figure 15:
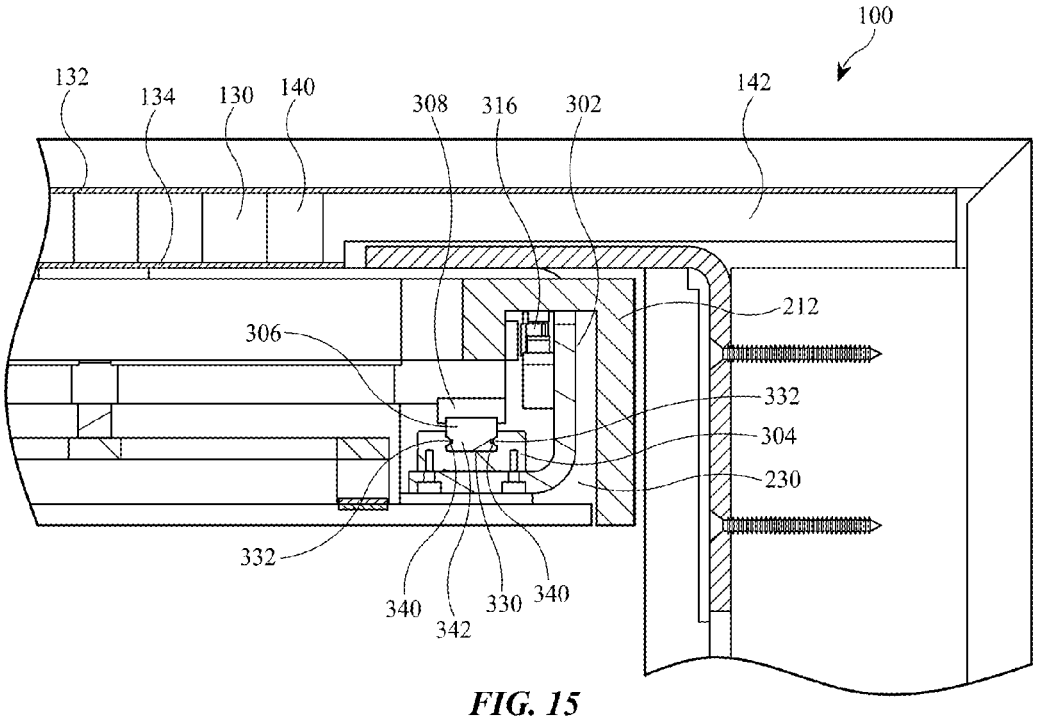
FIG. 15 shows a partial cross-sectional view of a table according to some embodiments, taken along line 15-15 of FIG. 1.

(see, e.g., FIGS. 8, 10, and 15). In some embodiments, carriage mechanism 300 may include a plurality of carriages 304. In some embodiments, carriage 304 may include a groove 330. In some embodiments carriage 304 may also include opposing protrusions 332 protruding from, for example, sides of groove 330. Carriage mechanism 300 may include a rail 306 coupled to drawer 200. Rail 306 may extend from a rear of the drawer 200. Rail 306 may include opposing grooves 340 and a protrusion 342.

Figure 17:
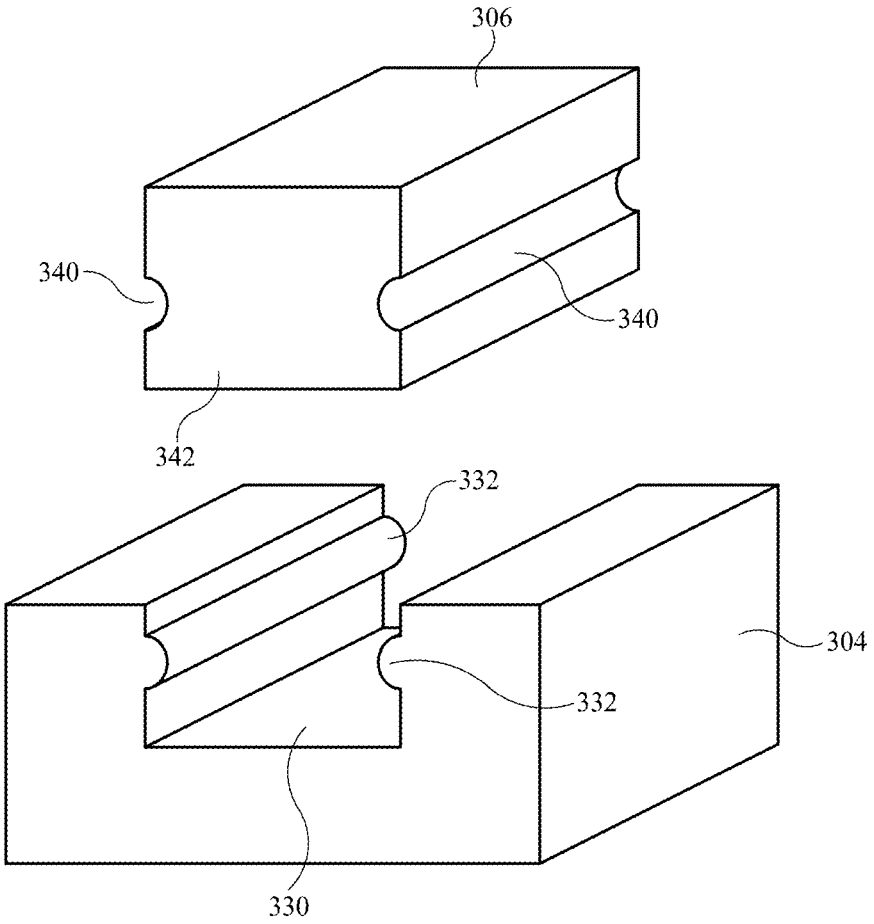
FIG. 17 shows an exploded perspective view of portions of a carriage mechanism according to some embodiments.

FIG. 15 shows a cross-section of carriage mechanism showing rail 306 engaged with carriage 304. FIG. 17 shows an exploded perspective representation of a portion of rail 306 and carriage 304. Protrusion 342 may have a profile sized and shaped to correspond to the size and shape of carriage groove 330, including opposing rail grooves 340, which may correspond in size and shape to opposing carriage protrusions 332. In some embodiments, protrusion 342 embodies the full cross-section of rail 306, along at least a portion of rail 306. Rail 306 may slide along carriage 304, moving drawer 200 between an open position and a closed position. Rail 306 may remain engaged with carriage 304 throughout movement of drawer 200 between the open and closed positions. Engagement of rail 306 and carriage 304 may be maintained at least in part by engagement of rail protrusion 342 within carriage groove 330.

In some embodiments, a spacer 308 may be disposed above rail 306 and beneath a drawer slide cover 310 of side panel 212. In some embodiments, at least a portion of drawer slide cover 310 may be an interior feature of drawer 200, such as a portion of a rim or tray. Spacer 308 may be sandwiched between rail 306 and drawer slide cover 310 to support drawer at a desired height above carriage 304 and bracket extension arm 322. Spacer 308 may minimize shaking of rail 306 when sliding along carriage 304 and may help rail 306 slide smoothly along carriage 304 (e.g., by maintaining bottom surface 214 of drawer 200 spaced apart from carriage 304, thereby preventing any friction or other interference therebetween). In this way, drawer 200 may smoothly slide relative to extension arm 322 to move between open and closed positions.

Bracket 302 may extend rearward from the rear of drawer 200 (e.g., out from side panel cavities 230 via openings 206) and may remain in a fixed position relative to table top 102 whether drawer 200 is open or closed. Bracket 302 may act as an encasement for members of carriage mechanism 300. For example, bracket 302 may help protect rail 306 or carriage 304 from tampering or inadvertent damage. Spacer 308 may help rail 306 remain coupled to carriage 304 and prevent rail 306 from moving out of place.

In some embodiments mounting panel 320 of bracket 302 may be fixed to table top lower surface 106 to thereby fix bracket 302 relative to table top 102. In some embodiments carriage 304 may be fixed to an upper surface of bracket extension arm 322 using any type of fastening mechanism, such as, but not limited to, clamps, screws, bolts, adhesive, and welding. In some embodiments, mounting panel 320 is fixed to table top lower surface 106 in a secure position to ensure that drawer 200 remains in position. For example, mounting panel 320 may be fixed to table top lower surface 106 at locations corresponding to support blocks 142 of support panel 116 (e.g., by fasteners driven through mounting panel 320 and into support blocks 142). In some embodiments, drawer 200 may be attached to table 100 only through mounting panel 320. In some embodiments mounting panel 320 is disposed entirely behind drawer 200, whether drawer 200 is in an open or closed position. Attaching drawer 200 to table only in an area behind drawer 200 allows for other use of areas beside, above and below drawers. For example, adjacent drawers can be spaced closer together, drawers can be positioned closer to lower surface 106 of table top 102, and more space can be maintained below drawers 200.

In some embodiments, one or more carriages 304 are fixed to an upper surface of each bracket extension arm 322 in a secure position. For example, two carriages 304 may be fixed to each bracket extension arm 322 to allow rail 306 to slide smoothly along spaced-apart carriages 304 without racking or shaking of carriage mechanism 300 when drawer 200 is moving between open and closed positions.

In some embodiments, drawers 200 may include a hollow side panel 212. In some embodiments hollow side panel 212 (including drawer slide cover 310) may form side panel cavity 230. For example, hollow side panel 212 may not be sealed on all sides but may form cavity 230 as shown, for example, in FIG. 15. In some embodiments, side panel cavity 230 is also partially defined by bottom panel 216 (see, e.g., FIG. 15). Side panel cavity 230 may have an opening 206 at the rear of drawer 200. In some embodiments, at least when drawer 200 is closed, extension arm 322 of bracket 302 and carriages 304 fixed thereto may be disposed within side panel cavity 230 of hollow side panel 212. Rail 306 may be fixed relative to drawer and disposed within side panel cavity 230 of hollow side panel 212. Rail 306 may extend rearward from hollow side panel 212 from opening 206 of drawer 200. In operation, rail 306 may slide along carriage 304 and relative to bracket extension arm 322 such that bracket extension arm 322 is inserted a greater distance or a lesser distance within cavity 230, depending on the direction of motion of drawer 200 (e.g., whether drawer 200 is being moved to a closed or an open position).

Figure 9:
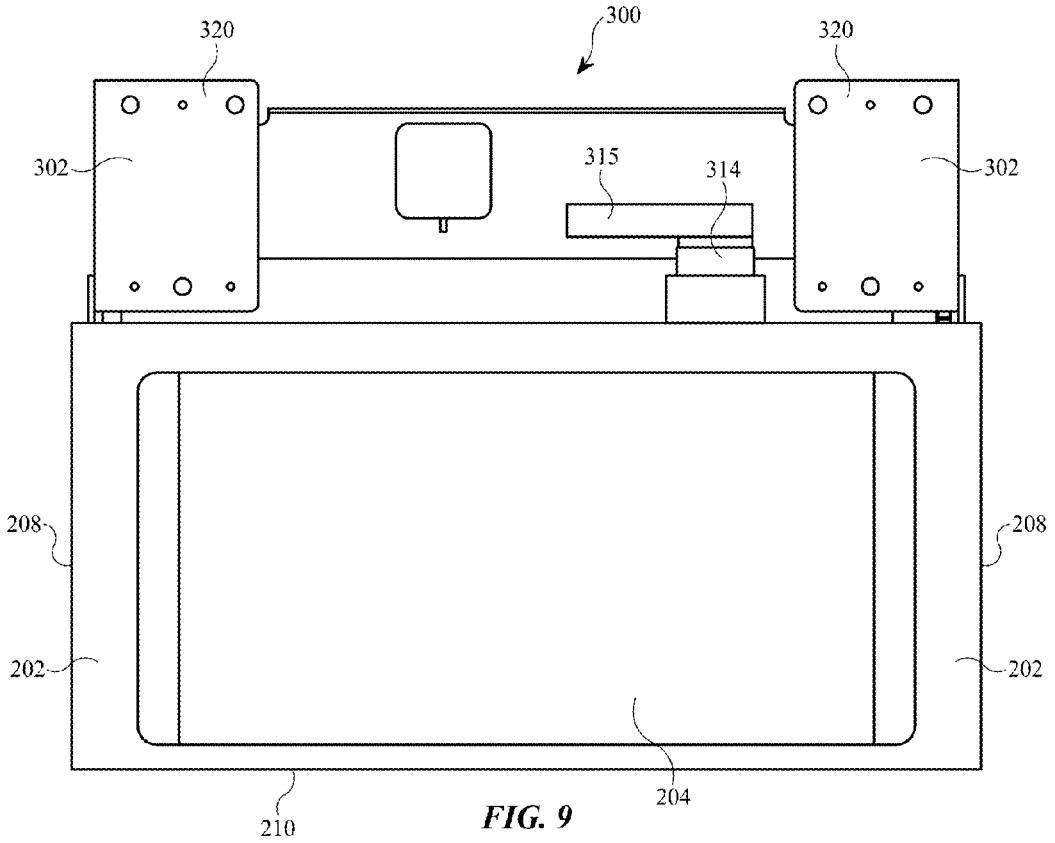
FIG. 9 shows a top plan view of a drawer according to some embodiments.
Figure 13:
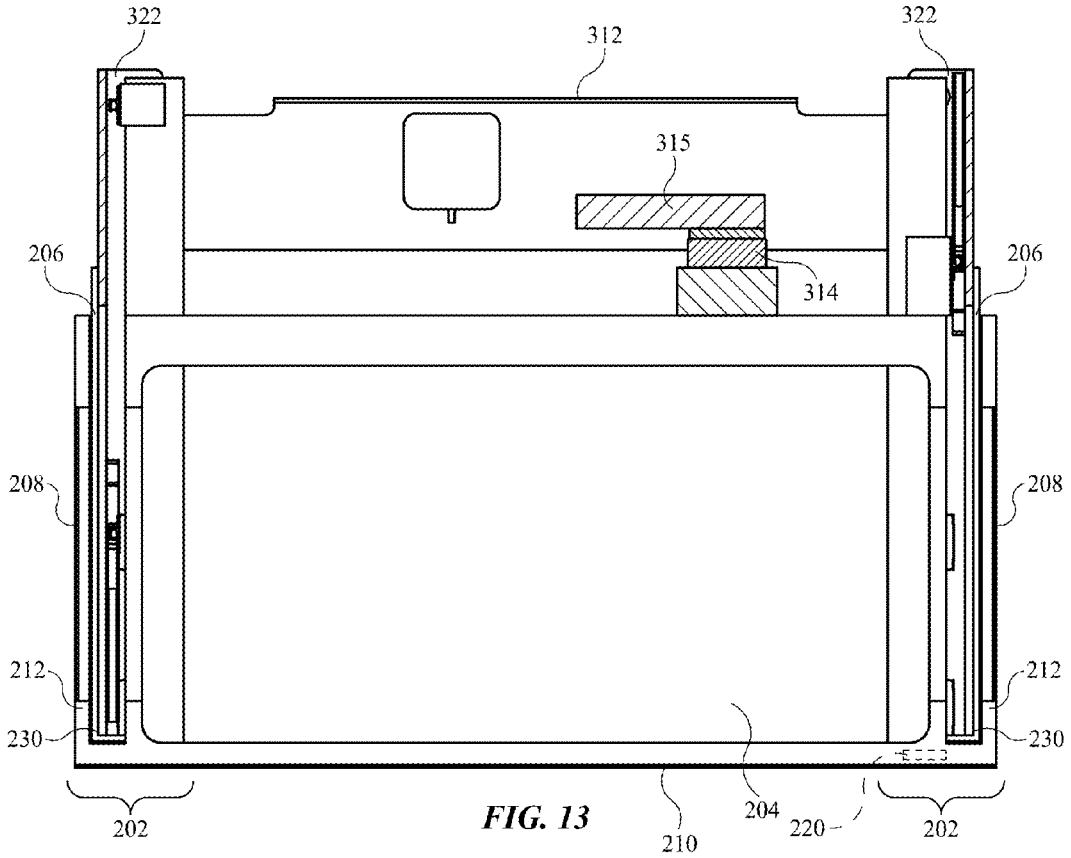
FIG. 13 shows a cross-sectional view of a drawer according to some embodiments, taken along line 13-13 of FIG. 11.
Figure 14:
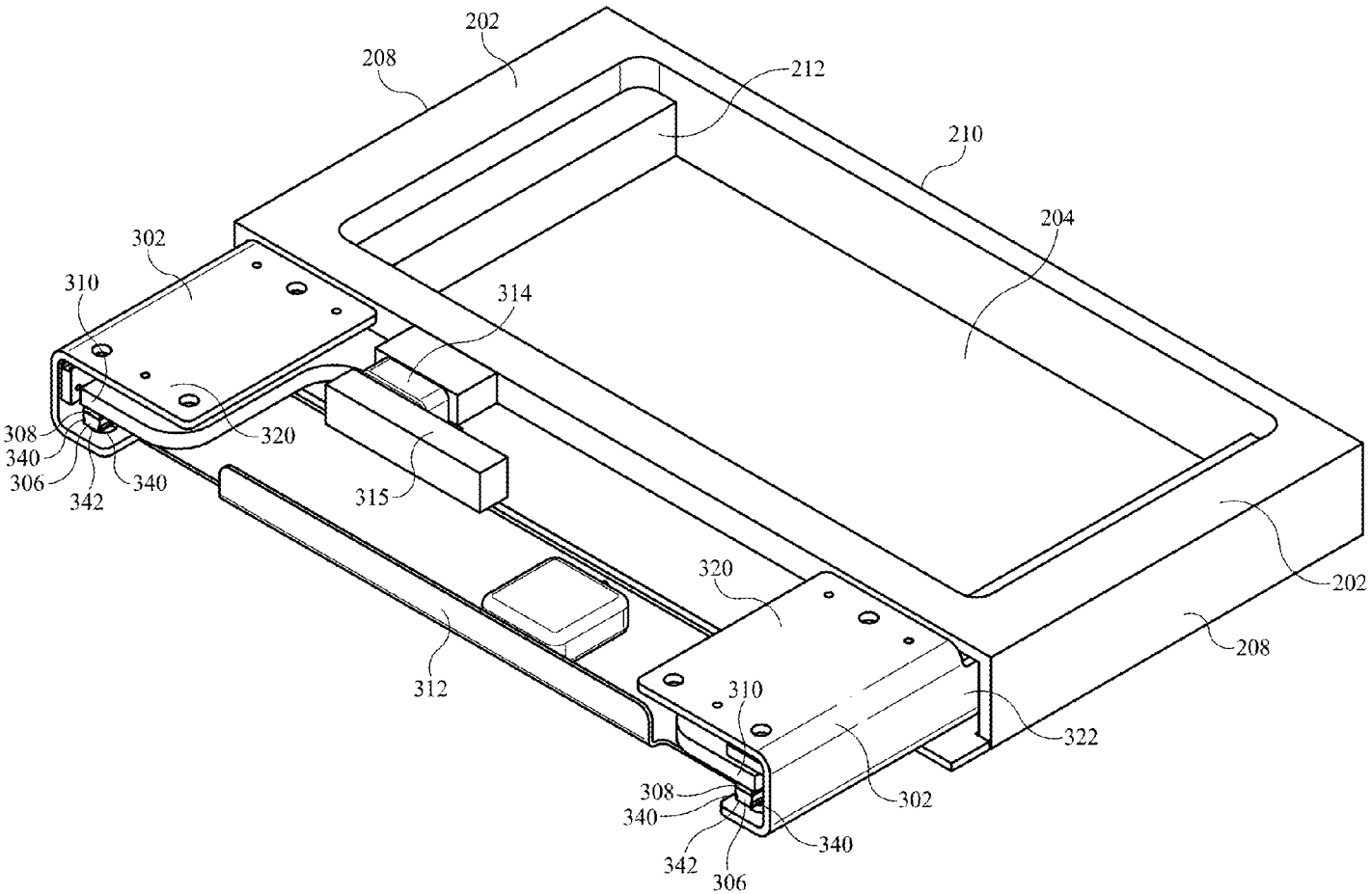
FIG. 14 shows a perspective view of a drawer according to some embodiments.

As shown in FIGS. 9, 11, and 13, carriage mechanism 300 may include a lock 314. When carriage mechanism 300 is locked, lock 314 may prevent drawer 200 from being opened. Lock 314 may be coupled to a security block 315 when lock 314 is engaged, and drawer 200 may not open. Lock 314 may be disengaged by, for example, inserting and turning a key in a keyhole of lock 314 (e.g., accessible from under table 100), or by sensor identification (e.g., at or remote from lock 314). For example, lock 314 may be disengaged when an authorized device, signal, or tag comes into virtual contact with a sensor 221 of table 100, which may occur through a sensor antenna 220 coupled to or otherwise in communication with sensor 221 (i.e., when an authorized device, signal, or tag is sensed by sensor antenna 220 (e.g., is within a sensing range of sensor antenna 220)).

When lock 314 is disengaged, lock 314 may decouple from security block 315 and drawer 200 may be allowed to be opened. In some embodiments, sensor antenna 220 may be located beneath front surface 210 of drawer 200 (e.g., within peripheral side wall 202). In some embodiments, sensor antenna 220 may be located at the location of lock 314. In some embodiments, sensor antenna 200 may be located within table top 102. In some embodiments, sensor antenna 220 may not be located on table 100. For example, sensor antenna 220 may be located on a wall or chair near table 100, or other remote locations. Sensor antenna 220 may have a limited range, so as to only detect a device, signal, or tag placed near to sensor antenna 220. For example, the range of sensor antenna may extend just above or adjacent the surface of table 100 (e.g., upper surface 104 of table top 102 or front surface 210 of drawer 200). This can help minimize the chance of inadvertently unlocking lock 314, since it requires a user to place their device, signal, or tag in the right location on the appropriate surface, which takes knowledge of the right location and deliberate action unlikely to be taken inadvertently. In some embodiments a user may interact with sensor 221 directly, without a sensor antenna 220, such as when sensor 221 is a biometric scanner such as a fingerprint scanner.

When lock 314 is disengaged, lock 314 may decouple from security block 315 and drawer 200 may be allowed to be opened. In some embodiments, sensor antenna 220 may be located beneath front surface 210 of drawer 200 (e.g., within peripheral side wall 202). In some embodiments, sensor antenna 220 may be located at the location of lock 314. In some embodiments, sensor antenna 200 may be located within table top 102. In some embodiments, sensor antenna 220 may not be located on table 100. For example, sensor antenna 220 may be located on a wall or chair near table 100, or other remote locations. Sensor antenna 220 may have a limited range, so as to only detect a device, signal, or tag placed near to sensor antenna 220. For example, the range of sensor antenna may extend just above or adjacent the surface of table 200 (e.g., upper surface 104 of table top 102 or front surface 210 of drawer 200). This can help minimize the chance of inadvertently unlocking lock 314, since it requires a user to place their device, signal, or tag in the right location on the appropriate surface, which takes knowledge of the right location and deliberate action unlikely to be taken inadvertently. In some embodiments a user may interact with sensor 221 directly, without a sensor antenna 220, such as when sensor 221 is a biometric scanner such as a fingerprint scanner.

Types of sensors (and corresponding devices, signals, or tags) that may be used in accordance with the embodiments described herein include, but are not limited to, fingerprint sensors, radio-frequency identification (RFID) sensors, weight sensors, motion sensors, capacitive touch sensors, and bar code (including quick response (QR) code) scanners. A motion sensor may send a signal in response to sensing the motion (e.g., an authorized motion) of an object, such as a hand. A capacitive touch sensor may send a signal in response to sensing a touch, for example, the touch of a finger (e.g., in an authorized sequence). A weight sensor may send a signal upon sensing a weight above or below a threshold weight. An RFID sensor may send a signal upon sensing identification information on an employee's or technical assistant's RFID card (e.g., via an authorized passive or active RFID tag). A bar code scanner may send a signal upon reading a bar code associated with an employee or technical assistant (e.g., an authorized bar code). Controlling access to drawers 200 (e.g., via sensors 221 as described), may increase security within a retailer's store.

As shown in FIG. 12, lower support member 312 may be fixed to the bottom side of a portion of extension arm 322 that extends rearward from the rear of drawer 200, and may extend between two brackets 302. Lower support member 312 may provide structural reinforcement to carriage mechanism 300, and may maintain desired spacing between brackets 302 for a given drawer 200 (e.g., to match spacing of side panel cavities 230 of drawer 200). Lower support member 312 may have a rear vertical flange to help protect the rear of carriage mechanism 300 by minimizing its potential for coming into contact with structures rearward of carriage mechanism 300. In some embodiments, hardware or accessories of carriage mechanism 300 may be disposed on lower support member 312. For example, lock 314 and security block 315 may be fixed to lower support member 312. In some embodiments, lower support member 312 is formed of the same material as brackets 302 (e.g., metal, such as aluminum or steel).

As described, in some embodiments, rail protrusion 342 may be at least partially disposed within carriage groove 330. Carriage protrusions 332 may be at least partially disposed within rail opposing grooves 340. Rail protrusion 342 may then slide along carriage 304, moving drawer 200 between an open position and a closed position. Positioning of rail protrusion 342 within carriage groove 330 and carriage protrusions 332 within rail opposing grooves 340 promotes proper alignment of carriage mechanism 300 (e.g., so that both rails 306 of a given drawer 200 translate parallel to upper surface 104 of table top 102 and perpendicular to side surface 107 of table top 102 with minimal deviation). This positioning helps to maintain rail 306 in engagement with carriage 304. Rail 306 may slide along carriage 304 in a smooth and continuous motion.

As shown in FIG. 10, the length of extension arm 322 may be longer than the length of drawer 200. The length of rail 306 may span the length of drawer 200. This allows an overlap length between rail 306 and bracket extension arm 322 even when drawer 200 is open, to maintain engagement of rail 306 and carriage 304 so that drawer 200 can be closed.

In some embodiments of the present invention, force applied to drawer 200 may transfer to other parts of table 100. In some embodiments, since drawers 200 are mounted fixedly to support panel 116 (e.g., at support blocks 142), force applied to one or more drawers 200 (e.g., in an open position) may transfer directly to support panel 116, and from there may transfer through other elements of table 100 (e.g., support beam 114, support beam 118, and legs 108). The transfer of force in this way may help maintain drawer in solid connection to and alignment with table top 102, even when subjected to force placed upon drawer 200.

As shown in FIGS. 6 and 9-14, exposed portions of carriage mechanism 300 are located at the rear of drawer 200, while other elements of carriage mechanism 300 extend within cavities of drawer 200. Arranging carriage mechanism 300 in this way may be beneficial for various reasons. For example, positioning exposed portions of carriage mechanism 300 behind drawer 200 allows concealment of carriage mechanism 300 underneath table top 102. In combination with those portions concealed within cavities of drawer 200, carriage mechanism 300 is entirely hidden from an observer viewing drawer from above table top 102, and is only accessible from underneath table top 102. In this arrangement all components of carriage mechanism 300 are concealed, even when drawer 200 is opened. This helps minimize potential interference with or damage to carriage mechanism 300 by persons or occurrences around table 100. This also presents a clean, aesthetically pleasing appearance when drawer 200 is opened.

Also for example, the arrangement of carriage mechanism 300 at the rear of the drawer 200 minimizes wasted space. Positioning carriage mechanism 300 components behind and within drawer 200 avoids use of intervening mechanisms or interruptions between adjacent drawers. Further, positioning components of carriage mechanism 300 behind drawer 200 arranges them in areas that may otherwise be unoccupied wasted space behind drawer 200. This reduces the space used in other areas around and within drawers 200. This positioning of carriage mechanism 300 also allows for a greater number of drawers 200 to fit underneath table 100 in side-by-side configuration, as shown in FIGS. 1 and 4.

Figure 16:
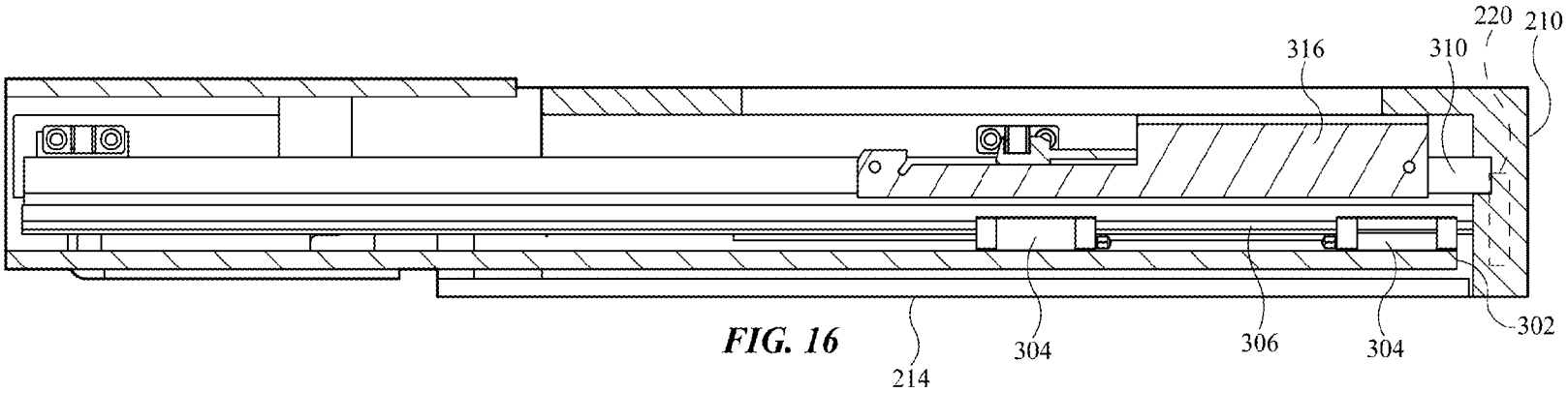
FIG. 16 shows a cross-sectional view of a drawer according to some embodiments, taken along line 16-16 of FIG. 11.

Also for example, the arrangement of carriage mechanism 300 at the rear of drawer 200 allows for a smooth and quiet motion. As shown in FIGS. 15 and 16, carriage mechanism 300 may include an insulating glide cover 316. Insulating glide cover 316 may be disposed between drawer slide cover 310 and bracket 302. Insulating glide cover 316 may act as a noise dampener to help insulate the drawer mechanism from noise caused by rail 306 sliding along carriage 304, by itself absorbing noise and other vibration. Insulating glide cover 316 may help drawer 200 move quietly between closed and open positions.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not target to be exhaustive or to limit the embodiments to the precise forms disclosed. It will be apparent to one of ordinary skill in the art that many modifications and variations are possible in view of the above teachings.

The Detailed Description section is intended to be used to interpret the claims. The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A table comprising:

a table top defining an upper surface and a lower surface;

a first drawer disposed beneath the lower surface of the table top, the first drawer comprising a side panel, wherein the side panel defines a cavity with an opening at a rear of the first drawer;

a second drawer immediately adjacent to the first drawer; and a carriage mechanism comprising an extension arm disposed within the side panel cavity and extending through the opening at the rear of the first drawer, wherein the first drawer is movable between a first position and a second position by sliding relative to the extension arm, and wherein there is no intervening mechanism between adjacent outer side surfaces of the first and second drawers.

2. The table of claim 1, wherein the side panel further comprises outer side surfaces forming outer side faces of the first drawer, and wherein the outer side surfaces are bare.

3. The table of claim 1, wherein the first drawer further comprises a front surface, and wherein the front surface is bare.

4. The table of claim 1, wherein the side panel further comprises outer side surfaces forming outer side faces of the first drawer, wherein the outer side surfaces are bare;

wherein the first drawer further comprises a bottom surface, and wherein the bottom surface is bare.

5. The table of claim 1, wherein the first drawer is closed in the first position and the first drawer is open in the second position, and wherein, the carriage mechanism is not visible from any perspective above the table top upper surface when the first drawer is in the first position and the second position.

6. A table comprising:

a table top defining an upper surface and a lower surface;

a drawer disposed below the table top;

a carriage mechanism for moving the drawer between a first position and a second position, the carriage mechanism comprising:

a bracket comprising a mounting panel fixed to the lower surface of the table top and comprising an extension arm extending toward the drawer;

a carriage coupled to an upper surface of the bracket extension arm, wherein the carriage defines a longitudinal groove; and a rail coupled to the drawer, wherein the rail extends from a rear of the drawer, wherein the bracket is entirely disposed rearward of the drawer, wherein the rail is slidably disposed in the groove of the carriage, and wherein the rail is configured to translate within the groove of the carriage to slidably move the drawer between the first position and the second position.

7. The table of claim 6, wherein the sides of the rail define opposing longitudinal grooves, wherein the sides of the carriage define opposing longitudinal protrusions at least partially disposed within the longitudinal grooves of the rail, and wherein the longitudinal grooves slide over the longitudinal protrusions when the drawer moves between the first position and the second position.

8. The table of claim 6, wherein the drawer comprises a hollow side panel, wherein the rail is disposed within the hollow side panel, and wherein the rail extends from a rear opening thereof.

9. The table of claim 6, further comprising a second drawer immediately adjacent to the first drawer, wherein there is no intervening mechanism between adjacent outer side surfaces of the first and second drawers.

10. The table of claim 6, wherein the bracket extends rearward from the rear of the drawer, wherein the bracket mounting panel is mounted to the lower surface of the table top at a position rearward of the drawer when the drawer is in the first position, and wherein the drawer is closed in the first position.

11. The table of claim 6, wherein the bracket remains in a fixed position relative to the table top whether the drawer is in the first position or the second position.

12. The table of claim 6, wherein the carriage mechanism is not visible from any perspective above the table top upper surface when the drawer is in the first position or the second position.

13. A table comprising:

a table top coupled to a table leg, the table top comprising a support beam and a support panel disposed above the support beam, wherein the support beam comprises:

a longitudinally extending branch;

a first transversely extending branch that extends from a first end of the longitudinally extending branch; and a second transversely extending branch that extends from a second end of the longitudinally extending branch, wherein the support panel comprises:

a middle panel;

a top sheet extending over and fixed to a top side of the middle panel; and a bottom sheet extending over and fixed to a bottom side of the middle panel.

14. The table of claim 13, wherein the support beam is metal.

15. The table of claim 13, wherein the longitudinally extending branch, the first transversely extending branch, and the second transversely extending branch of the support beam are connected in the form of an "I" shape.

16. The table of claim 13, wherein the middle panel of the support panel comprises a honeycomb structure.

17. The table of claim 13, wherein at least one of the middle panel, the top sheet, and the bottom sheet is aluminum.

18. The table of claim 13, further comprising a support block disposed within the middle panel of the support panel, wherein the support block defines at least a portion of the middle panel of the support panel and wherein the top sheet of the support panel is disposed on top of the support block and the bottom sheet of the support panel is disposed beneath the support block, and wherein the support block has greater density than portions of the middle panel immediately adjacent the support block.

19. The table of claim 13, further comprising:

a support block disposed within the middle panel of the support panel, wherein the support block has greater density than portions of the middle panel immediately adjacent the support block; and a drawer mounted to the support block.

20. The table of claim 13, further comprising:

a plurality of spaced-apart support blocks disposed within the middle panel of the support panel, wherein each support block has greater density than immediately adjacent portions of the middle panel; and a plurality of drawers mounted to the support block.

21. The table of claim 13, further comprising a drawer mounted to the support panel, wherein the drawer is only connected to the support panel in an area rearward of the drawer.

22. The table of claim 13, wherein the longitudinally extending branch of the support beam extends through the middle third of the table top.

23. The table of claim 13, comprising:

a first side support beam and a second side support beam, wherein the table leg is coupled to the first side support beam and a second table leg coupled to the second side support beam.

* * * * *